US012448707B2

(12) United States Patent
Laukamp et al.

(10) Patent No.: US 12,448,707 B2
(45) Date of Patent: Oct. 21, 2025

(54) DEVICE FOR FEEDING WEFT THREADS TO A GRIPPER HEAD OF A LOOM

(71) Applicant: LINDAUER DORNIER GESELLSCHAFT MIT BESCHRAENKTER HAFTUNG, Lindau (DE)

(72) Inventors: Thomas Laukamp, Lindau (DE); Peter Schiller, Lindau (DE); Harald Horelt, Argenbuehl (DE)

(73) Assignee: LINDAUER DORNIER GESELLSCHAFT MIT BESCHRAENKTER HAFTUNG, Lindau (DE)

( * ) Notice: Subject to any disclaimer, the term of this patent is extended or adjusted under 35 U.S.C. 154(b) by 0 days.

(21) Appl. No.: 18/554,863

(22) PCT Filed: Mar. 23, 2022

(86) PCT No.: PCT/EP2022/057579
§ 371 (c)(1),
(2) Date: Oct. 11, 2023

(87) PCT Pub. No.: WO2022/223225
PCT Pub. Date: Oct. 27, 2022

(65) Prior Publication Data

US 2024/0200241 A1 Jun. 20, 2024

(30) Foreign Application Priority Data

Apr. 19, 2021 (DE) ..... 10 2021 203 879.4

(51) Int. Cl.
*D03D 47/24* (2006.01)

(52) U.S. Cl.
CPC ..... *D03D 47/24* (2013.01)

(58) Field of Classification Search
CPC ..... D03D 47/345; D03D 47/24; D03D 47/16; D03D 47/34; D03D 47/12; D03D 47/125; D03D 41/008
(Continued)

(56) References Cited

U.S. PATENT DOCUMENTS 3,517,704 A * 6/1970 Gustav ..... D03D 47/00 139/450
3,596,683 A * 8/1971 Dendo ..... D03D 47/00 139/452
(Continued)

FOREIGN PATENT DOCUMENTS

DE 10 2012 212169 A1 1/2014
EP 3 425 094 B1 4/2020
(Continued)

OTHER PUBLICATIONS

PCT Search Report and Written Opinion—Nov. 18, 2022.

*Primary Examiner* — Grace Huang
(74) *Attorney, Agent, or Firm* — Dority & Manning, P.A.

(57) ABSTRACT

A device feeds first and second weft threads in a weft direction to a gripper head of a loom and includes a coupling unit that moves back and forth in a warp direction. A first and a second feed unit are adjacently arranged in the warp direction on the coupling unit and are configured to feed the first and the second weft threads to the gripper head. A positioning unit moves the coupling unit in the warp direction in a first position of the coupling unit and counter to the warp direction in a second position of the coupling unit. The first feed unit feeds the first weft thread to the gripper head when the coupling unit is in the first position and the second feed unit feeds the second weft thread to the gripper head when the coupling unit is in the second position.

18 Claims, 5 Drawing Sheets

(58) Field of Classification Search
USPC ..... 139/450
See application file for complete search history.

(56) References Cited

U.S. PATENT DOCUMENTS

| | | | | | |
|---|---|---|---|---|---|
| 4,291,731 | A * | 9/1981 | Prohazka | D03D 47/24 | 139/438 |
| 4,784,191 | A * | 11/1988 | Umemura | D03D 47/34 | 226/118.1 |
| 5,501,250 | A * | 3/1996 | Edwards | D05C 11/16 | 139/453 |
| 7,007,723 | B2 * | 3/2006 | Debaes | D03D 47/125 | 139/453 |
| 7,992,596 | B2 * | 8/2011 | Khokar | D03D 49/60 | 139/420 R |
| 8,550,123 | B2 * | 10/2013 | Laukamp | D03D 47/12 | 139/420 R |
| 9,328,437 | B2 * | 5/2016 | Mueller | D03D 47/363 | |
| 2018/0127901 | A1 * | 5/2018 | Mo | D06M 11/74 | |

FOREIGN PATENT DOCUMENTS

| | | | | |
|---|---|---|---|---|
| GB | 489980 | A * | 8/1938 | D03D 47/34 |
| JP | 2983531 | | 11/1999 | |
| KR | 100822409 | B1 * | 4/2008 | D03D 41/008 |
| WO | WO 2011/015173 | A1 | 2/2011 | |
| WO | WO-2020011915 | A1 * | 1/2020 | D03D 47/34 |

* cited by examiner

1
KR
SR
84
82
G
SE
50, 51
30, 31
S2
S1
D2
E
70, 75

84
82
S1
S2
D2
E
70, 75

SE
50
30
S2
S1
E
D1
70, 75

KR
84
82
79
SE
30, 50
S1
S2
SR
S1
S2
72
70
71
76
77
75

1
15
16
17
20
21
22
31
31,30
41
42
43
44
45
46
51
51,50
56
10
11
KR
SR

DEVICE FOR FEEDING WEFT THREADS TO A GRIPPER HEAD OF A LOOM

FIELD OF THE INVENTION

The invention relates to a device for feeding at least first and second weft threads to a loom which has at least one gripper head, the weft threads being feedable to the gripper head in the weft direction.

BACKGROUND

WO 2011/015173 A1 discloses a device for temporally successively transferring two preferably strip-type weft threads, which are also referred to as tapes, from a respective feed unit associated with a weft thread to a gripper head of a loom. By suitably controlling the feed units, either the first weft thread or the other weft thread is fed to the gripper head and subsequently inserted into the shed. The two feed units are arranged one above the other and oriented in the weft direction for this purpose. Each feed unit has a clamping device for clamping a free end of the respective weft thread, the clamping device being movable essentially in the weft direction between at least two different operating positions. Furthermore, each clamping device is movable by means of a swivel unit which is driven by a drive, preferably a servomotor, and includes two parallel swivel arms which are connected by a coupling element, the clamping device being arranged on the coupling element.

Due to the movement of each clamping device only in a vertical plane, in which the weft insertion line is also situated, the strip-type weft material takes a course which is largely twist-free and does not deflect in the warp direction from the feed unit until transferred to the gripper head. As a result, shear forces which could damage the weft thread do not arise. Deflection therefore does not take place in the direction of the width extension of the strip-type weft material. If the clamping device is movable in the aforementioned vertical plane, in which the weft insertion line is also situated, various feed movements can be carried out by means of the device, a deflection not being carried out in the direction of the width extension of the strip-type weft material. In order to transfer a strip-type weft thread, its free end is initially clamped in the associated clamping device then transferred to the gripper head and, thereafter, the clamping device is opened and the weft material is inserted.

This known device has the disadvantage, however, that it is relatively complex and costly. It also requires a relatively large amount of space. Last but not least, due to the swivel kinematics during the movement of the clamping device in the weft direction, an undesired movement of the weft thread upward also takes place, i.e., in the vertical direction with respect to the plane, in which the weft insertion line is also situated. This negatively affects the accuracy of presenting the weft thread to the gripper head and also the cutting position of the weft thread once it is inserted into the shed.

JP 2983531 A describes a loom, in which a color selection between two weft threads is made possible. For this purpose, either a first weft thread from a first bobbin or a second weft thread from a second bobbin, which is arranged next to the first bobbin in the warp direction, is inserted into the open shed and, thereafter, the inserted and cut first or second weft thread is pushed onto the selvedge. This design requires, in particular, that the inserted weft thread situated farther away from the selvedge must be moved a relatively great distance to the selvedge, wherein undesired friction-related problems can arise. The apparatus-related complexity is also relatively high in this case.

SUMMARY OF THE INVENTION

A problem addressed by the present invention is that of providing a device for feeding at least first and second weft threads, preferably strip-type weft threads, to a loom which has at least one gripper head, the device at least partially eliminating the aforementioned disadvantages. Additional objects and advantages of the invention will be set forth in part in the following description, or may be obvious from the description, or may be learned through practice of the invention.

The objects are provided by a device and a method having the features set forth herein.

The device according to the invention has a coupling unit which is movable back and forth in the warp direction when the device is installed laterally on the loom. This coupling unit connects at least a first feed unit and a second feed unit to one another, the feed units being adjacently arranged in the warp direction and designed such that they enable at least a first and a second weft thread, respectively, to be fed to the gripper head. Furthermore, the device according to the invention has a positioning unit for positioning the coupling unit in or counter to the warp direction in at least a first position and a second position, wherein the first feed unit is designed to feed the first weft thread to the gripper head when the coupling unit is in the first position and the second feed unit is designed to feed the second weft thread to the gripper head when the coupling unit is in the second position.

The advantages of the invention are, in particular, that the coupling unit, in connection with the positioning unit, positions the at least first feed unit and second feed unit in or counter to the warp direction such that, after suitable positioning, the first weft thread or the second weft thread can be presented to the gripper head. For example, in the first position of the coupling unit, the first feed unit transfers the first weft thread to the gripper head which subsequently inserts the first weft thread into the open shed of the loom. Once this first weft thread has been inserted into the shed, its free end close to the device according to the invention is cut, the first feed unit is moved back and, thereafter, the coupling unit is moved in the warp direction into the second position such that the second feed unit is transferred into a position in which it can transfer the second weft thread to the gripper head.

In this way, at least two weft threads, for example, each made from a different type of material, can be quickly and easily inserted into a woven fabric.

The approach according to the invention has multiple advantages over the approach described in WO 2011/015173 A1. On the one hand, the weft thread to be inserted can be fed to the gripper head in a linear manner. In this feed movement, in contrast to the swivel kinematics according to WO 2011/015173 A1, this weft thread does not move in the vertical direction, i.e., the weft thread is always located in the same vertical position. Due to this feature, high flexibility with respect to feed movements and possibilities for presenting the weft thread which is to be transferred to the gripper head is also achieved. The device according to the invention also requires only a small amount of installation space.

Since the invention makes it possible to move the weft thread, which has been presented and transferred to the gripper head and then drawn through the shed, only in the horizontal and linear directions, i.e., without a vertical movement component, for weft insertion, the control unit can be freely programmed with respect to the presentation movement of the weft thread. As a result, greater presentation accuracy and a more precise cut of the weft thread once it is inserted into the shed can be achieved. A height offset taking place at the same time, as in WO 2011/015173 A1, does not need to be taken into consideration.

The advantages of a presentation which takes place only in the linear direction with a weft-thread selection (color selection) by means of laterally, i.e., in and counter to the warp direction, displaceable feed units is that the two feed units can be identically designed and then also exhibit the same behavior in the presentation movement. Good adjustability and positionability of the two feed units results for the same reason, since these have an identical position with respect to height.

It is preferred that the coupling unit is positionable such that the position of the first feed unit when the coupling unit is in the first position and the position of the second feed unit when the coupling unit is in the second position match in the warp direction during weft insertion. In this case, the first and the second feed units take the previous position of the other feed unit at different times, for example, one after the other, in order—in this position—to present the corresponding weft thread to the gripper head which is movable through the open shed. Despite the displacement of the coupling unit in or counter to the warp direction for the purpose of selecting color, the weft thread to be inserted therefore always lies on the ideal insertion axis, while the other weft thread is slightly deflected laterally in or counter to the warp direction.

It is to be noted that the gripper head can be movable from the one selvedge to the other selvedge through the shed or the weft thread can be transferred to a second gripper head, for example, half-way through, the second gripper head then pulling the weft thread along the second half of the path through the shed.

According to one advantageous embodiment, the at least two feed units each have slides that are movable in the weft direction. The slides are preferably linearly movable in and counter to the weft direction, whereas they are both movable back and forth, preferably also linearly, in the warp direction by means of the coupling unit.

It is advantageous when at least one and preferably exactly one drive, preferably a servomotor, is coupled to the at least two slides such that the drive is capable of moving only one of the at least two slides in and counter to the weft direction. The drive therefore moves both slides, but not at the same time, and, instead, moves only one of the two. Whereas the one slide is therefore moved, for example, in the weft direction in order to transfer the associated weft thread to the gripper head, the other slide remains in place. Therefore, only little mass (specifically the particular feed unit) is moved, unnecessary mechanical imbalance is avoided and the space required at the side of the loom is optimally utilized. When only the aforementioned one drive is used to move the two slides forwards and backwards (at different times), this is a cost-effective and space-saving approach.

Each slide preferably has a clamp which is to be closed and opened via electrical or pneumatic control for clamping and releasing the weft thread. It is preferred that each clamp, as viewed in the weft direction, has upstream guide elements which guide the weft thread on the top side and the underside and laterally, the guide elements also being part of the slide. In this way, the free end of the weft thread to be transferred does not freely hang down directly after the clamp, but rather advantageously only—as viewed in the weft direction—after the guide elements and is guided by the slide in a defined manner in the weft direction to the gripper head in order to be received by the gripper head.

The at least one drive is preferably controllable such that the slide and preferably its guide elements are guidable to different distances away from or even into the gripper head. This possibility for presenting a weft thread in an individually variable manner is also a standalone aspect of the invention, which can be realized regardless of the claimed design of the coupling unit, the feed units and the positioning unit. This adapted presentation movement can preferably be realized by means of a flexible programming of the drive. Mechanical adjustments for different weft threads, in particular for materials having low bending stiffness, are advantageously not necessary.

Specifically, this aspect of the invention, which is also to be considered as a standalone invention, relates to a device for feeding at least one first weft thread to a loom which has at least one gripper head, the device having at least one first feed unit, with which the at least one weft thread is feedable to the gripper head in the weft direction, wherein the first feed unit has a first clamp, with which at least one portion of the at least one first weft thread can be guided in a force-locked manner when this weft thread is fed to the gripper head. This device is characterized in that the portion of the at least first weft thread which is guided by the first clamp is linearly conveyable by means of the first feed unit in and counter to the weft direction with respect to the gripper head, this linear movement of the aforementioned portion of the at least first weft thread taking place along the weft insertion line.

With such an embodiment, for example, a relatively flexible weft thread can continue to be inserted into the open gripper head, thereby ensuring that the weft thread is reliably transferred. In other words, the presentation of the weft thread to be inserted is flexible. Various parameters can be taken into account in the programming of the control unit by suitably controlling the feed unit.

In this aspect of the invention, which is also to be considered as a standalone invention, the at least first feed unit has a first slide which is movable by means of a drive, preferably a servomotor, in and counter to the weft direction, which also applies for the above-described embodiment having the at least two feed units. The aforementioned clamp can also be advantageously closed and opened via electrical or pneumatic control, wherein guide elements are advantageously provided, the guide elements being situated upstream of the clamp as viewed in the weft direction and guiding the first weft thread on the top side and the underside and laterally. The clamp and the guide elements of the first slide are guidable to different distances away from or into the gripper head by means of the drive.

By means of the aforementioned aspect of the invention, it is possible, in particular, to not only insert the weft thread itself into the gripper head, but also into the front part of the feed unit, which is advantageously made use of, in particular, with relatively flexible weft threads. In this way, the flexible weft thread, which projects beyond the feed unit in the weft direction and is securely guided thereby, arrives behind the clamping region of the gripper head and is not stopped ahead of the clamping region, for example, by parts of the gripper head facing the feed unit. In this over-insertion, the feed unit therefore travels briefly between the clamping region and then back counter to the weft direction, the weft thread to be clamped projecting beyond the feed unit to such an extent that it remains in the clamping region despite the feed unit having been moved back and is clamped when the gripper head is subsequently closed.

In the above-described aspect of the invention, which is also considered as standalone, it is preferred that a second feed unit having a second slide is provided in addition to the first feed unit having the first slide, both feed units being controllable as described above, in order to enable, in particular, the above-described over-insertion, i.e., also dipping the front part of the feed unit or its slide into the clamping region.

Referring back to the design according to the invention having a coupling unit, at least two feed units and a positioning unit, the at least two feed units can each have a strip-conveying unit in an embodiment which is an alternative to the aforementioned slides. Each strip-conveying unit has two revolving strip conveyors which are positionable in relation to each other and between which the weft thread is conveyable with frictional engagement at least in the weft direction. If the strip conveyors of the feed unit enter into frictional engagement with the weft thread, the clamped weft thread is conveyed in the weft direction by driving the strip conveyors in the opposing directions in order to present the free end of the weft thread to the gripper head. In this embodiment, the strip conveyors preferably remain in their position with respect to the weft direction, i.e., always at the same distance from the longitudinal edge of the woven fabric. As is the case with the aforementioned embodiment of the slides, the strip conveyors, however, according to the invention, are moved back and forth in the warp direction due to the coupling with the coupling unit, in order to position the at least first or second weft thread for transfer to the gripper head.

Preferably, the positioning unit has a drive, preferably a motor (for example, a servomotor) or a pneumatic cylinder, for positioning the coupling unit. This drive can move to positions that correspond to the first and the second positions of the coupling unit. When the drive is, for example, a pneumatic cylinder, its two end positions can correspond to the first and the second positions of the coupling unit. An extremely simple and easily controlled design results.

The coupling unit which is movable in the warp direction is particularly preferably coupled to a fixed, i.e., stationary, guide part. This advantageously has first guide structures, whereas the coupling unit has guide elements which correspond to these first guide structures. The first guide structures and the guide elements interact in such a way that the coupling unit is positionable exclusively in and counter to the warp direction.

The first guide structures are preferably also designed such that they not only allow the coupling unit to be positioned in and counter to the warp direction, but also simultaneously prevent one of the at least two feed units from moving in the weft direction, and such that two guide structures are provided on the guide part, which permit the other feed unit, which is not prevented from moving, from moving in and counter to the weft direction. The first and the second guide structures preferably extend orthogonally to each other and cross each other, corresponding to the warp direction and the weft direction which extend orthogonally to each other. Provided the coupling unit is moved by means of the first guide structures in and counter to the warp direction, the first feed unit or the second feed unit cannot move in the weft direction. The feed unit can be moved only once the coupling unit has been positioned in the first or second position.

According to one advantageous embodiment, the first and the second guide structures are formed by grooves and/or protrusions in the guide part. As a result, it is made possible for the coupling unit to move back and forth only in the warp direction, whereas movements in other directions, in particular directions which are orthogonal thereto, are prevented. On the other hand, once the coupling unit has been suitably positioned, it is made possible for the corresponding feed unit to move only in the weft direction.

In order to feed a first weft thread at the lateral edge of the loom, a first weft thread storage unit is preferably provided, which is set up farther away and has a first bobbin which stores the first weft thread. The first weft thread is guidable from here to the first feed unit. Similarly, in order to feed a second weft thread at the lateral edge of the loom, a second weft thread storage unit is preferably provided, which is set up farther away and has a second bobbin which stores the second weft thread. The second weft thread is guidable from here to the second feed unit.

Preferably, between the first weft thread storage unit and the first feed unit, a first guide element is arranged directly ahead of the first feed unit. Furthermore, between the second weft thread storage unit and the second feed unit, a second guide element is preferably arranged directly ahead of the second feed unit. The first and the second guide elements extend next to one another at least directly ahead of the associated first and second feed units, respectively. Preferably, the aforementioned first guide element and the second guide element are coupled to the first feed unit and the second feed unit, respectively, and are displaced back and forth in the warp direction due to the movement of the coupling unit. Alternatively, the first and the second guide elements are stationary.

According to one advantageous embodiment, the first weft thread storage unit is arranged over the second weft thread storage unit, the bobbin axis of the first weft thread storage unit being situated above the bobbin axis of the second weft thread storage unit. This arrangement is space-saving. In this preferred embodiment, the two weft threads therefore emerge from their respective weft yarn storage units extending one above the other, while they are situated next to one another for the purpose of being presented to the gripper head.

Preferably, the first and the second weft thread storage units are aligned in the weft direction, the axes of the first and the second bobbins then being aligned in the warp direction. According to one alternative, the first and the second weft thread storage units are aligned in the warp direction, the axes of the first and the second bobbins then being aligned in the weft direction and deflection means are provided for deflecting the first weft thread and the second weft thread in the weft direction. Specific space requirements for the loom and in the weaving mill can be taken into account here.

The invention also relates to a loom having at least one gripper head which is movable through the open shed in and counter to the weft direction, and to an above-described device.

The invention further relates to a method for feeding at least first and second weft threads during the production of woven fabric by means of a loom having at least one gripper head, preferably utilizing a device of one of the preceding claims, wherein at least one first weft thread and one second weft thread are located in a plane in the warp direction next to one another at an edge of the woven fabric and are fed sequentially in time (not necessarily alternatingly) in the weft direction to the gripper head of the loom, wherein the at least first and second weft threads are positioned in and counter to the warp direction for their weft insertion such that they are each drawn through the open shed along the weft insertion line by at least one gripper head, wherein the weft thread which is not to be inserted at the moment is deflected out of the weft insertion line (E) in or counter to the warp direction in order to clear the weft insertion line.

Particularly preferably, the device according to the invention and the method according to the invention can be used for strip-type weft threads and strip-type weft materials, for example, those that contain carbon filaments, glass filaments and/or basalt fibers or filaments. Strip-type weft threads and strip-type weft materials having various widths can be processed.

BRIEF DESCRIPTION OF THE DRAWINGS

The invention is explained in greater detail in the present case with reference to figures, wherein.

DETAILED DESCRIPTION

Figure 1A:
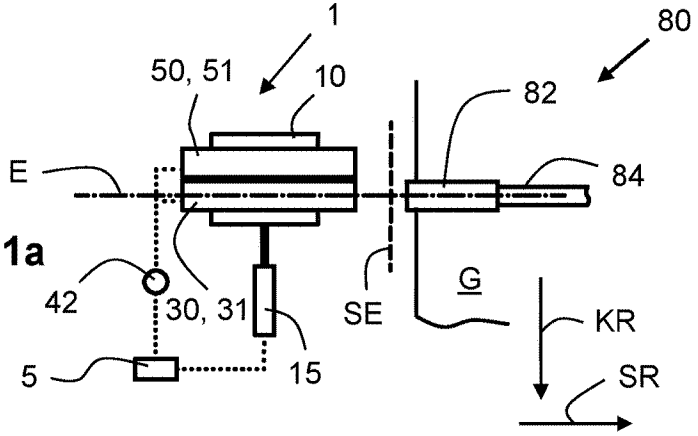
FIGS. 1*a*-1*f*: show a top view of a schematically shown device according to the invention (without weft threads) with feed units which include slides, in various positions.
Figure 1B:
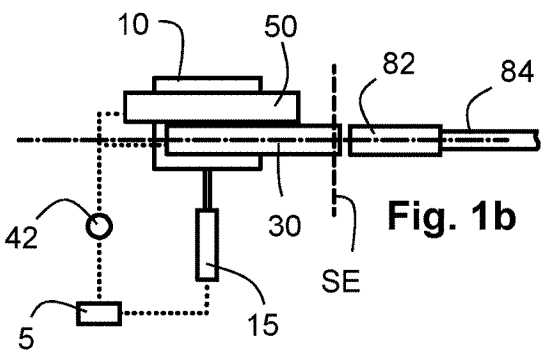

Reference will now be made to embodiments of the invention, one or more examples of which are shown in the drawings. Each embodiment is provided by way of explanation of the invention, and not as a limitation of the invention. For example features illustrated or described as part of one embodiment can be combined with another embodiment to yield still another embodiment. It is intended that the present invention include these and other modifications and variations to the embodiments described herein.

The top view from FIGS. 1*a*-1*f* highly schematically shows a device 1 according to the invention, which is designed to feed first and second weft threads S1, S2 (not shown in FIG. 1 for the sake of clarity; see FIGS. 2*a*-2*d*) to a gripper head 82 of a loom 80 which is shown highly schematically only in the cutout portion. The device 1 is arranged laterally with respect to the loom 80 and presents the first and the second weft threads S1, S2, which are to be inserted, to the gripper head 82.

The device 1 has a coupling unit 10, on which a first feed unit 30 and a second feed unit 50 are provided, the first feed unit 30 presenting the first weft thread S1 to the gripper head 82 and the second feed unit presenting the second weft thread S2 to the gripper head 82. The gripper head 82 pulls the weft thread, which has been presented thereto and subsequently clamped, through the open shed along the weft insertion line E by means of the gripper rod 84.

The two feed units 30, 50 are motion-coupled to each other via the coupling unit 10. The coupling unit 10 is movable by means of a drive 15, which is a pneumatic cylinder 16 having a pushing and pulling cylinder rod 17 (FIG. 3*a*) in the present case, along the woven-fabric edge in and counter to the warp direction KR in two defined positions in this case. Due to this movement of the coupling unit 10, the two feed units 30, 50 are also positioned in the warp direction KR.

In the present case, the first feed unit 30 and the second feed unit 50 include slides 31 and 51, respectively, which are movable in and counter to the weft direction SR. The first and the second slides 31, 51 are driven by means of a commonly used drive 42 which is a servomotor in the present case and is controlled by a control unit 5, the pneumatic cylinder 16 also being controlled by the control unit 5. The corresponding control lines are shown as dotted lines in FIG. 1.

In FIG. 1*a*, the coupling unit 10 is in a first position. In this first position of the coupling unit 10, the first feed unit 30 takes a position in which the first weft thread S1 lies in the weft insertion line E. According to FIG. 1*b*, the coupling unit 10 is still in the aforementioned first position, but the first feed unit 30 has advanced in the weft direction SR to the gripper head 82. In this position, the weft thread S1 is presented and transferred to the gripper head 82, whereupon the gripper head 82 travels through the open shed. After the first weft thread has been presented, the first feed unit 30 is moved counter to the weft direction SR back into its starting position by means of the drive 42.

Figure 1C:
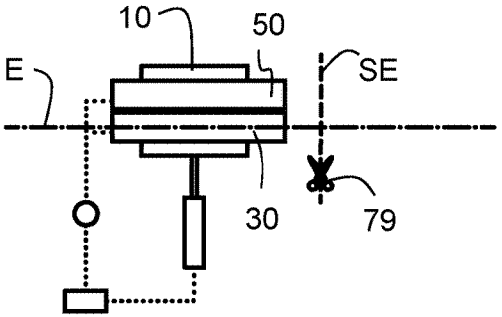

According to FIG. 1*c*, the weft thread S1 can then be cut in the cutting plane SE by means of a cutting device 79 which is only schematically shown.

Figure 1D:
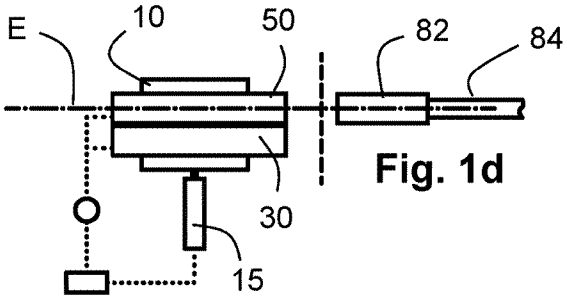
Figure 1E:
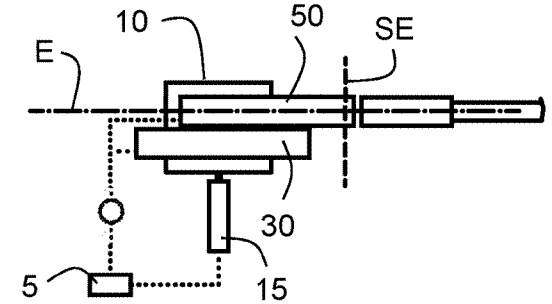
Figure 1F:
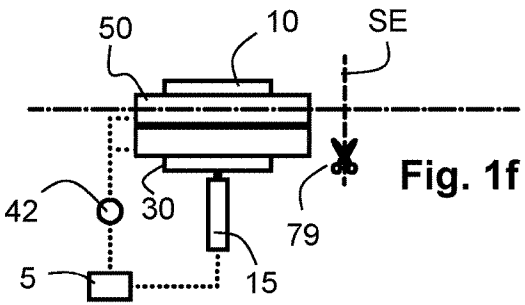

According to FIG. 1*d*, the coupling unit 10 is subsequently moved by means of the pneumatic cylinder 16 into its second position, in which the second weft thread S2, which has been placed in the second feed unit 50, is aligned with the weft insertion line E. According to FIG. 1*e*, the second feed unit 50 is moved in the weft direction SR by means of the drive 42 to the gripper head 82, where the weft thread S2 is transferred. Thereafter, according to FIG. 1*f*, the second feed unit 50 moves back into its starting position and the second weft thread S2 is cut by means of the cutting device 79. Thereafter, the coupling unit 10 can be moved back into the position according to FIG. 1*a*.

FIGS. 2*a*-2*d* show the device 1 according to FIG. 1 in a schematic top view without a few features and showing other features. In the side view in FIG. 2*d*, it is apparent that the first weft thread S1 in an upper weft thread storage unit 70 is wound onto a bobbin 72. From there, the first weft thread S1 is guided via a deflecting roller 71 to the first feed unit 30. Arranged under the first, upper weft thread storage unit 70 is a second, lower weft thread storage unit 75 which stores a second bobbin 77 with the weft thread S2 wound thereon. From there, the second weft thread S2 is guided via a deflecting roller 76 to the second feed unit 50. The two weft thread storage units 70, 75 are aligned with each other in the top view (see FIGS. 2*a*-2*c*). The two weft threads S1, S2 initially extend essentially one above the other with very little clearance from each other, but then slightly apart from each other in the direction of the feed units 30, 50, as explained in the following with reference to FIGS. 2*a*-2*c*.

Figures 2A, 2B, 2C, 2D:
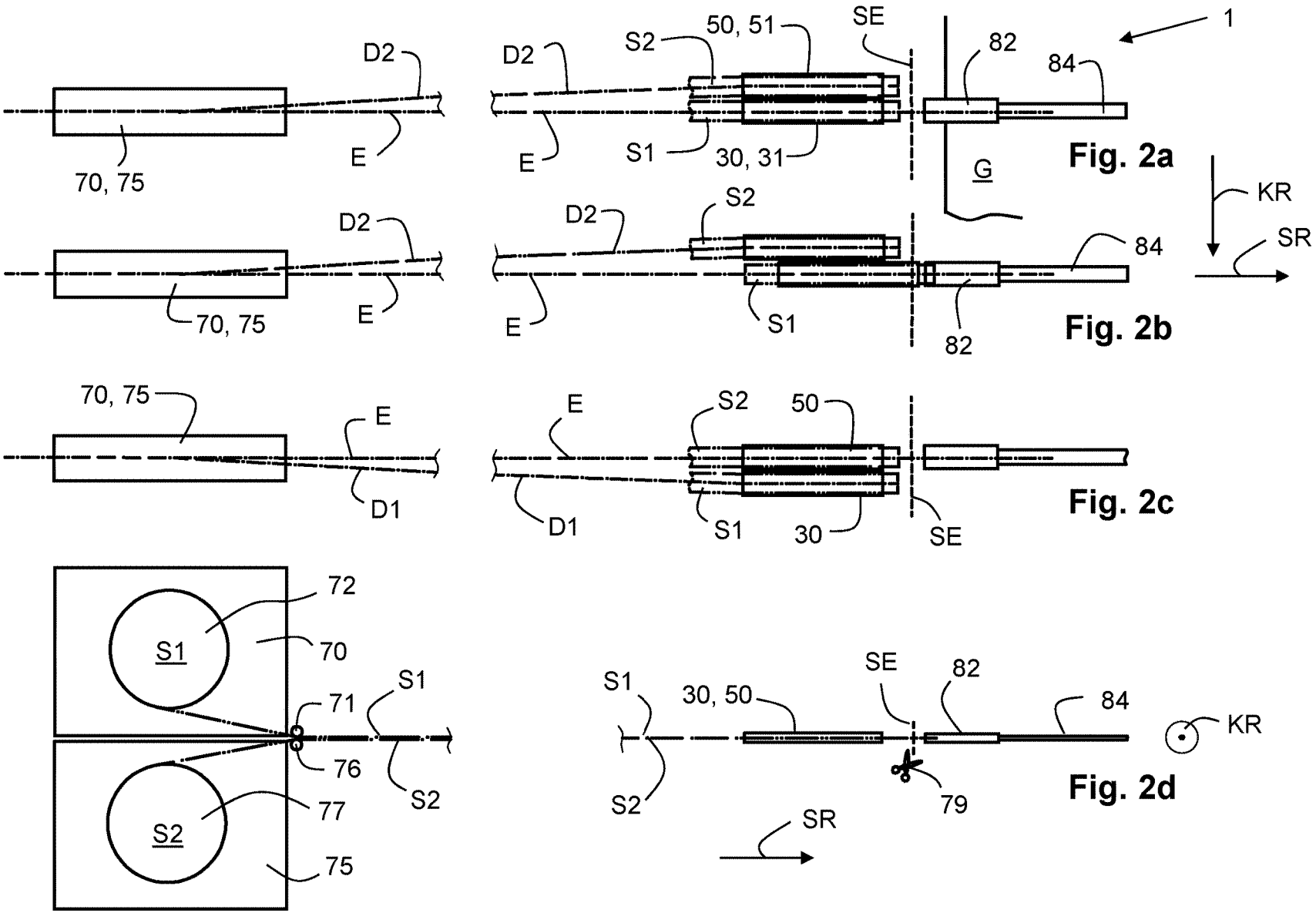
FIGS. 2*a*-2*c*: show a top view of the schematically shown device from FIGS. 1*a*-1*f* with inserted weft threads and weft thread storage units.
FIG. 2*d*: shows a side view of the schematically shown device according to FIGS. 2*a*-2*c;*

According to the top view in FIG. 2*a*, the first feed unit 30 with the slide 31 is located in a position—by suitably positioning the coupling unit 10 (not shown)—in which its weft thread S1 can be inserted along the weft insertion line E by means of the gripper head 82. The second feed unit 50 is deflected slightly counter to the warp direction KR. In order to illustrate this, the central axis D2 of the second weft thread S2 is extended to the weft thread storage units 70, 75. It therefore becomes clear that there is a small angle between the weft insertion line E and the central axis D2 of the second weft thread S2. This is not critical, however, since the second weft thread S2 is not being inserted into the shed in this moment.

FIG. 2*b* shows once again how the first feed unit 30 brings the weft thread S1 to the gripper head 82. According to FIG. 2*c*, the coupling unit 10 (not shown) has been moved into the second position, in which the second weft thread S2 is aligned with the weft insertion line E. In this case, the first feed unit 30 is positioned outside the weft insertion line E, the central axis D1 of the weft thread S1 forming a small angle with the weft insertion line E.

FIGS. 3*a*-3*d* show a specific embodiment of the device 1 which is shown merely schematically in FIGS. 1 and 2. In contrast to FIGS. 1 and 2, FIGS. 3*a*-3*d* show an underside view of a device 1. The pneumatic cylinder 16 with its cylinder rod 17 is apparent. The cylinder rod 17 is connected to the coupling unit 10, such that the pneumatic cylinder 16 can move the coupling unit 10 back and forth in the warp direction KR.

The coupling unit 10 is essentially U-shaped in the underside view in the present case, protrusions 11 being provided on its two limb ends, the protrusions pointing downward (i.e., toward the observer in this case). These protrusions 11 are engaged with a first guide structure 21 which is formed as a guide groove and is provided in a guide part 20. The guide part 20 is installed in a fixed, i.e., stationary, manner, which is also the case for the pneumatic cylinder 16. The guide part 20 is a flat cuboid in the present case, which is used essentially for guiding the coupling unit 10 and the two feed units 30, 50. The aforementioned first guide structure 21 in the guide part 20 extends in the warp direction KR, such that the coupling element 10 with its protrusions 11 is forcibly guided via the first guide structure 21 in and counter to the warp direction KR when it is set into motion by the pneumatic cylinder 16.

The two slides 31, 51 of the first and the second feed units 30, 50, respectively, are arranged on the coupling unit 10 Both slides 31, 51 can be moved in and counter to the weft direction SR. A drive mechanism is provided for this purpose, which is composed in this case of a drive 42 formed as a servomotor having a planetary transmission, a pivot lever 43 and a sliding block 45 which is stationarily arranged on the pivot lever but is rotatable by means of a rotational joint 44. Each of the two slides 31, 51 has on its underside (i.e., directed toward the observer) a recess 46 for the sliding block 45. The two recesses 46 are aligned with each other when the two slides 31, 51 are located at the same level in the weft direction SR (FIG. 3*a*, FIG. 3*c*).

A guide element 41 in the form of a protrusion is also provided on the underside of the first slide 31 and a guide element 56 which is also in the form of a protrusion is provided on the underside of the second slide 51. When the coupling unit 10 has been suitably positioned, specifically in its first or second position, these protrusions 41, 56 can slide, being forcibly guided, in and counter to the weft direction SR in a second guide structure 22 which is formed as a guide groove in the guide part 20 in the present case.

Figures 3A, 3B, 3C, 3D:
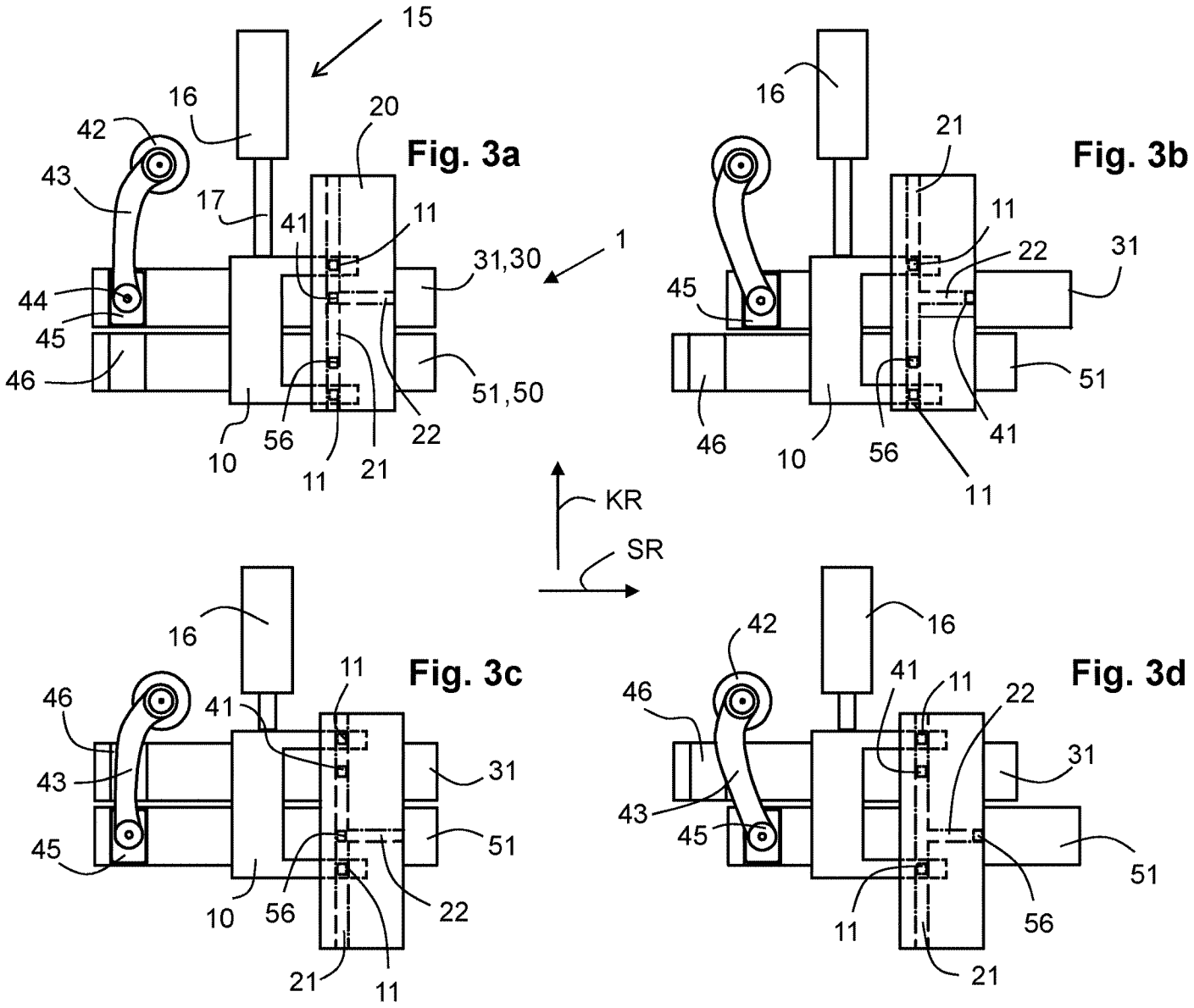
FIGS. 3*a*-3*d*: show an underside view of a schematically shown device according to the invention for illustrating the kinematics.

In FIG. 3*a*, the coupling unit 10 is shown in its first position, in which the first slide 31 is positioned such that it can be moved in the weft direction SR due to its protrusion 41. The protrusion 56 of the second slide 51 impacts the edge of the second guide structure 22, however, such that the second slide 51 is prevented from moving in the weft direction SR. In order to allow the second slide 51 to slide in the weft direction SR, the coupling unit 10 must be brought into its second position by means of the pneumatic cylinder 16 (see, for this purpose, the discussion associated with FIGS. 3*c* and 3*d* further below).

FIG. 3*b* shows how—driven by the drive 42 and the swivel mechanism including the sliding block 45—the first slide 31 has been advanced in the weft direction SR, i.e., in the direction of the gripper head 82 (not shown) and has been forcibly guided by the protrusion 41 running in the second guide structure 22.

In FIG. 3*c*, the first and the second slides 31, 51 are at the same level again. The pneumatic cylinder 16 has now moved the coupling unit 10 in the warp direction KR into its second position, however. The sliding block 45 has slid into the recess 46 in the second slide 51. Thereafter, as shown in FIG. 3*d*, the second slide 51 can be moved by the drive 42 in the weft direction SR in order to present and transfer the second weft thread S2 to the gripper head 82.

Figure 4:
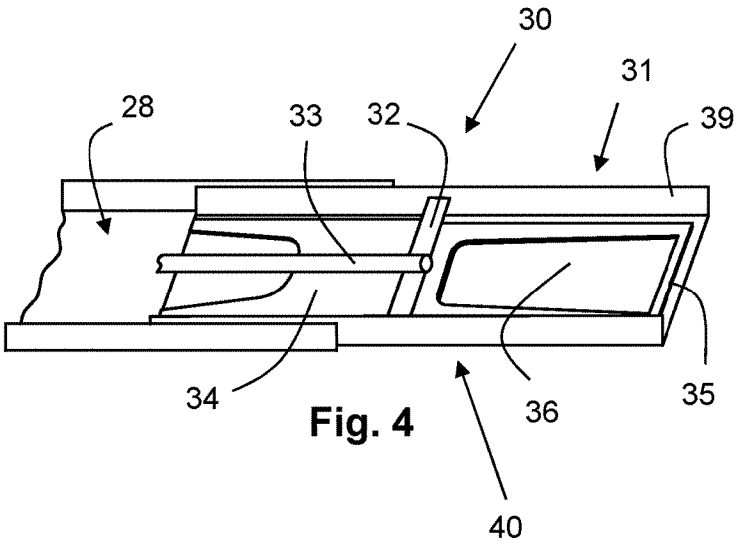
FIG. 4: shows a perspective top view of the front part of a slide.

In FIG. 4, the slide 31 of the feed unit 30 is shown in greater detail (the slide 51 of the feed unit 50 is preferably identical). In cross-section, the slide 31 has a metal plate 40 which is closed in a U-shaped manner. These two upwardly projecting lateral limbs of this metal plate 40 act as laterally guiding guide elements 39 for the weft thread (not shown), whereas the base of the metal plate 40 acts as a lower guide element 36. A clamp 32 is provided in the central area of the metal plate 40, which presses the weft thread downward by means of a pneumatically loaded push rod 33 (shown only in part). Situated upstream of the clamp 32 in the weft direction SR is an upper guide element 35 which is coupled to the clamp 32, has an open cross-section and presses the weft thread downward against the lower guide element 36 of the metal plate 40. The weft thread is therefore securely guided to the gripper head 82 laterally via the guide elements 39 and on its top side and its underside via the guide elements 35, 36.

Toward the rear, i.e., counter to the weft direction SR, the clamp 32 is also adjoined by an upper guide surface 34 for the weft thread, which is also oriented toward the U-shaped metal sheet, the weft thread passing between the metal sheet 40 and the upper guide surface 34.

In this embodiment, a first guide element 28, which is also U-shaped and which is optional, adjoins even farther toward the rear, in the direction of the weft thread storage unit 70. This is used for guiding the weft thread S1 to the first feed unit 30 in an ordered manner. The first guide element 28 is moved together with the first feed unit 30 in and counter to the warp direction KR (by means of the coupling unit 10). It is also advantageous, although not necessary, when it is also moved back and forth in the weft direction SR by means of the drive 42.

In summary, in the described embodiments, the weft thread S1 or S2 to be inserted is selected from the two adjacently situated weft threads S1, S2 via a lateral displacement of the coupling unit 10 taking place in and counter to the warp direction KR. The displacement of the coupling unit 10 in and counter to the warp direction KR is initiated pneumatically in the present case, whereas a drive 42 in the form of a servomotor carries out the presentation of the selected weft thread S1 or S2 to the gripper head 82, the presentation taking place in the weft direction SR. Due to the selection of the aforementioned drive, the device according to the invention can be cost-effectively realized, since only one servodrive may be used for the feed movement and one pneumatic drive may be used for selecting the color. In WO 2011/015173 A1, however, two servodrives are necessary for the swivel kinematics. The color can be selected by switching between the two weft threads S1, S2 by means of the relatively cost-effective pneumatic cylinder 16.

In FIGS. 5*a*-5*f*, a transfer or a presentation of a first weft thread S1 (the second weft thread S2 could just as easily have been selected) to a gripper head 82 is shown in chronological sequence. FIGS. 5*a*-5*f* also demonstrate the aspect of the invention, which is also to be considered as standalone, of a device for feeding at least a first weft thread S1 to a loom having at least one gripper head 82, in which a coupling unit 10, at least two feed units 30, 50 and a positioning unit 15 are not absolutely necessarily provided. Such a device has at least a first feed unit 30, with which the at least one weft thread S1 is feedable in the weft direction SR to the gripper head 82, the first feed unit 30 having a first clamp 32, with which at least one portion of the at least one first weft thread S1 can be guided in a force-locked manner when this weft thread S1 is fed to the gripper head 82. This device is characterized in that the portion of the at least first weft thread S1 which is guided by the first clamp 32 is linearly conveyable by means of the first feed unit 30 in and counter to the weft direction SR with respect to the gripper head 82, this linear movement of the aforementioned portion of the at least first weft thread S1 taking place along the weft insertion line E.

Figures 5A, 5B, 5C, 5D, 5E, 5F:
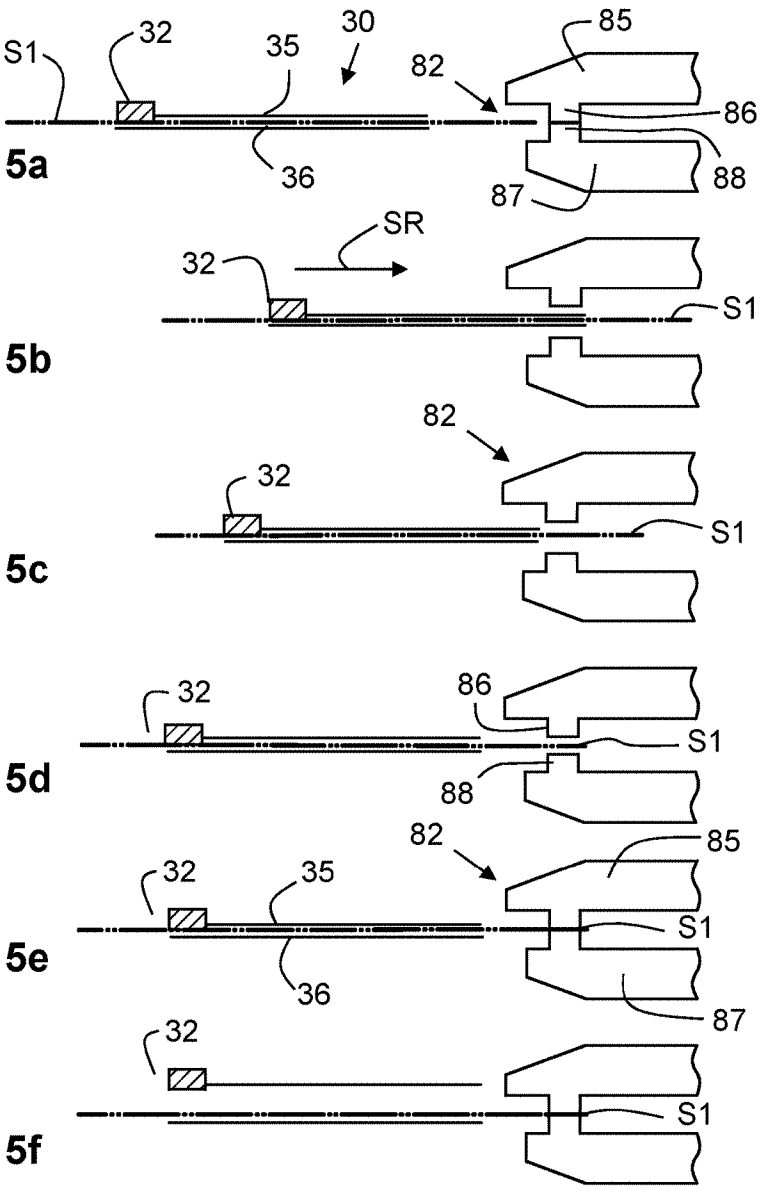
FIGS. 5*a*-5*f*: show a schematic side view of various approach positions of a slide in relation to a gripper head.

According to FIG. 5*a*, the weft thread S1 is clamped by the schematically shown clamp 32 and guided in the direction of the gripper head 82 on the top side and the underside by means of guide elements 35, 36. The weft thread S1 is relatively flexible in this case and is to be securely clamped by the gripper head 82. A transfer strategy is selected for this purpose. According to FIG. 5*b*, the gripper head 82 opens, the gripper head 82 having an upper gripper part 85 with an upper clamp part 86 and a lower gripper part 87 with a lower clamp part 88. The slide 31 including the weft thread S1 is now inserted between the two clamp parts 86, 88 by moving the first feed unit 30 in the weft direction SR. As a result, the weft thread S1 actually arrives in the gripper head 82, i.e., when the slide 31 is moved in the weft direction SR, the free end of the weft thread S1 does not impact the front side of the lower clamp part 88 for example, and then can no longer be conveyed into the gripper head 82.

According to FIGS. 5*c* and 5*d*, the feed unit 30 is then moved back out of the gripper head 82, the free end of the weft thread S1 remaining between the upper clamp part 86 and the lower clamp part 88, however. In this way it is ensured that the flexible weft thread S1 is actually inserted behind the two clamp parts 86, 88. As shown in FIG. 5*e*, the gripper head 82 is now closed, the upper clamp part 86 and the lower clamp part 88 clamping the free end of the weft thread S1 in a force-locking manner. According to FIG. 5*f*, the clamp 32 now opens, thereby lifting the upper guide part 35. Thereafter, the gripper head 82 can be moved in the weft direction SR through the open shed, thereby carrying the weft thread S1 along.

If the weft thread S1 has a relatively great bending stiffness, the step in FIG. 5*b*, i.e., inserting the slide 31 between the two clamp parts 86, 88, can be dispensed with. In this case, a reliable transfer of the weft thread S1 can be reliably realized due to the greater bending stiffness of the weft thread also without over-inserting the slide 31, i.e., inserting the slide 31 in the weft direction beyond the clamping region between the two clamp parts 86, 88.

FIGS. 6*a*-6*e* show an alternative embodiment for the feed units 30, 50. Instead of a slide, the feed units 30, 50 in this embodiment each have a strip-conveying unit 60, which has two revolving strip conveyors 62 which are positionable in relation to each other and between which the weft thread S1 or S2 is conveyable in the weft direction SR in a force-locked manner. In the present case, each strip conveyor 62 has three rollers, of which at least one is actively driven.

Figure 6D:
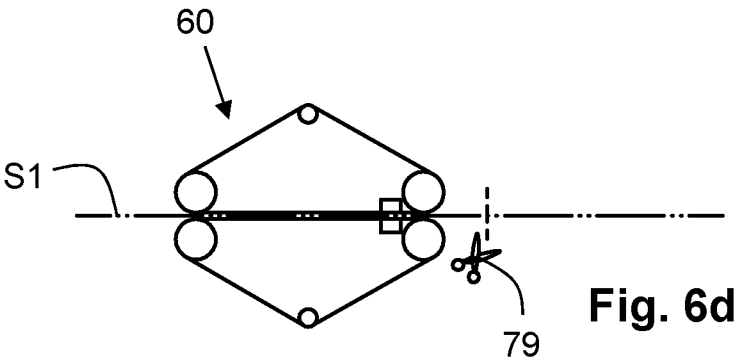
FIGS. 6*a*-6*e* show a schematic side view of another embodiment of a feed unit.
Figure 6E:
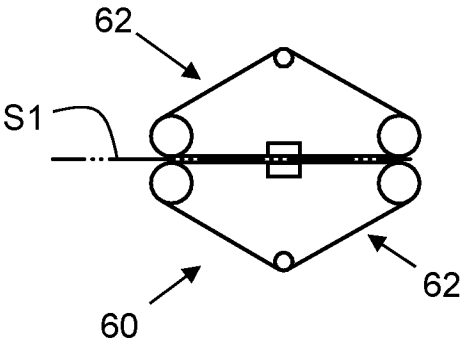
Figure 6A:
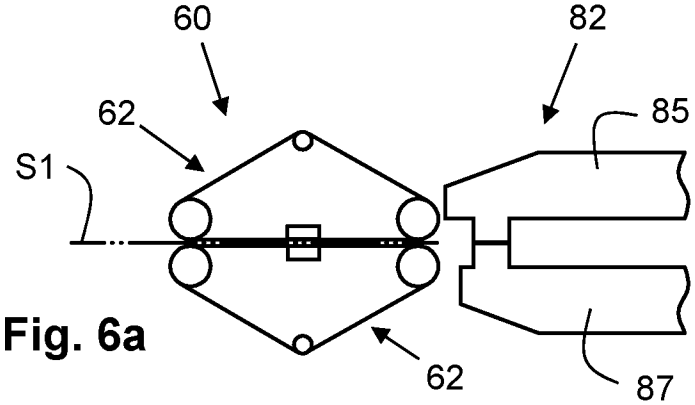
Figure 6B:
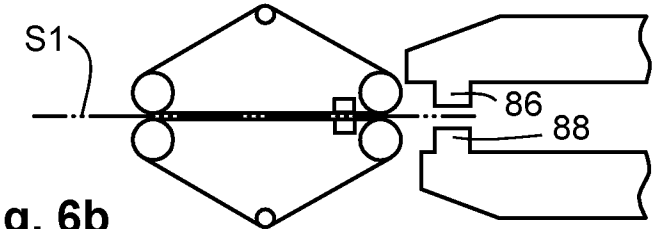
Figure 6C:
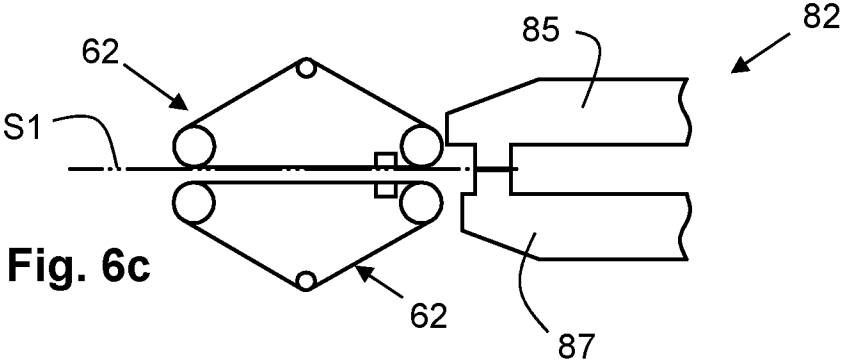

FIG. 6*a* shows that the two strip conveyors 62 clamp, for example, a weft thread S1 between themselves. When the gripper head 82 is open, according to FIG. 6*b*, the weft thread S1 is advanced between the two clamp parts 86, 88, whereupon the gripper head 82 closes and the weft thread S1 is clamped (FIG. 6*c*). The two strip conveyors 62 are then moved apart from each other, so that the gripper head 82 can pull the weft thread S1 through the shed. According to FIG. 6*d*, the inserted weft thread S1 is cut, the strip conveyors 62 having been moved back into the clamping position. Thereafter, the free weft thread end can be moved by the strip conveyors 62 counter to the weft direction SR back into its starting position (see FIG. 6*a*).

In a brief summary, according to the invention, the weft threads S1, S2 to be fed to the gripper head 82 are situated next to each other ahead of the woven-fabric edge in the warp direction KR. They preferably come from weft thread storage units 70, 75 which are arranged one above the other. The weft thread S1, S2 to be inserted is selected by laterally moving the coupling unit 10 together with feed units 30, 50 which are in the form of slides (presentation slides) or a strip-conveying unit 60 in this case. The coupling unit 10 is moved laterally in or counter to the warp direction KR such that the weft thread S1 or S2 is preferably inserted without deflection during the weft insertion, while the weft thread S2 or S1 which is not to be inserted is laterally deflected in or counter to the warp direction KR by a small amount on its way from the weft thread storage unit 75 or 70, respectively, to the feed unit 50 or 30, respectively. This does not negatively affect this weft thread S2 or S1, since it is not moved in the weft direction SR in this phase.

The device according to the invention and the method according to the invention can also be readily expanded to include more than two weft threads.

In addition to the advantages which were initially described, the presented method makes it possible to precisely produce highly diverse weave patterns. For example, weft threads having various widths and/or materials and/or having different pretreatment can be used in order, for example, to obtain a suitable structure and/or pattern. Two (or more) identical weft threads can also be used, of course. One further advantage of using identical weft threads is that the machine does not need to be stopped when the supply of one weft thread has been initially inserted into the woven fabric and then a switch to the other weft thread is carried out without a pause. While this weft thread is being inserted, the weft thread that previously ran out can be replaced in the appropriate weft thread storage unit. In general, longer runtimes can be achieved with identical weft materials and by exchanging the weft thread storage units.

LIST OF REFERENCE SIGNS

1 device
5 control unit
10 coupling unit
11 protrusions
15 positioning unit
16 pneumatic cylinder
17 cylinder rod
20 guide part
21 first guide structure

22 second guide structure
28 first and second guide elements
30 first feed unit
31 first slide
32 clamp
33 push rod
34 guide surface
35 upper guide elements
36 lower guide elements
39 laterally guiding guide elements
40 metal plate
41 guide element
42 drive (servomotor)
43 pivot lever
44 joint
45 sliding block
46 recess
50 second feed unit
51 second slide
56 guide element
60 strip-conveying unit
62 strip conveyor
70 first weft thread storage unit
71 deflecting roller
72 first bobbin
75 second weft thread storage unit
76 deflecting roller
77 second bobbin
79 cutting device
80 loom
82 gripper head
84 gripper rod
85 upper gripper part
86 upper clamp part
87 lower grip part
88 lower clamp part
S1 first weft thread
S2 second weft thread
G woven fabric
SR weft direction
KR warp direction
SE cutting plane
E weft insertion line

The invention claimed is:

1. A device for feeding a first and a second weft thread in a weft direction to a gripper head of a loom, the device comprising:

a coupling unit configured to move back and forth in a warp direction when the device is installed laterally on the loom;

a first and a second feed unit adjacently arranged in the warp direction on the coupling unit, the first and the second feed units configured to feed the first and the second weft threads, respectively, to the gripper head;

a positioning unit configured to move the coupling unit in only a linear axis path in the warp direction in a first position of the coupling unit and in only the linear axis path counter to the warp direction in a second position of the coupling unit; and wherein the first feed unit feeds the first weft thread to the gripper head when the coupling unit is in the first position and the second feed unit feeds the second weft thread to the gripper head when the coupling unit is in the second position.

2. The device of claim 1, wherein the coupling unit is positionable such that the position of the first feed unit in the first position of the coupling unit and the position of the second feed unit in the second position of the coupling unit match in the warp direction during weft insertion.

3. The device of claim 1, wherein each of the first and second feed units comprises slides that are movable in the weft direction.

4. The device of claim 3, wherein each of the slides is individually motor-driven in and counter to the weft direction.

5. The device of claim 4, wherein each of the slides are individually drivable to different distances away from or into the gripper head.

6. The device of claim 3, wherein each of the slides comprises an actuatable clamp configured to clamp and release the respective weft thread associated with each of the slides, and further comprising guide elements upstream of each of the clamps in the weft direction that guide the respective weft threads from above, below, and laterally.

7. The device of claim 1, wherein each of the feed units comprises a strip-conveying unit having two revolving strip conveyors positionable in relation to each other, wherein the respective weft threads are conveyable in the weft direction between the strip conveyors.

8. The device of claim 1, further comprising a drive configured with the positioning unit.

9. The device of claim 1, wherein the coupling unit is configured on a fixed guide part having first guide structures, the coupling unit comprising guide elements that interact with the first guide structures to move the coupling unit in the linear axis path in or counter to the warp direction.

10. The device of claim 9, wherein the first guide structures are configured to prevent one of the first or second feed units from moving in the weft direction as the coupling unit is positioned in and counter to the warp direction, and further comprising second guide structures on the guide part that enable the other of the second or first feed units to move in and counter to the weft direction.

11. The device of claim 10, wherein the first and second guide structures are formed by grooves or protrusions in or on the guide part.

12. The device of claim 1, further comprising a first weft thread storage unit having a first bobbin, the first weft thread guided from the first weft thread storage unit to the first feed unit, and a second weft thread storage unit having a second bobbin, the second weft thread guided from the second weft thread storage unit to the second feed unit.

13. The device of claim 12, wherein the first weft thread storage unit is arranged above the second weft thread storage unit such that the first weft thread and the second weft thread emerge from the first and second weft thread storage units, respectively, extending one above the other.

14. The device of claim 12, wherein:

the first and the second weft thread storage units are aligned in the weft direction and the axes of the first and the second bobbins are aligned in the warp direction, or the first and the second weft thread storage units are aligned in the warp direction and the axes of the first and the second bobbins being aligned in the weft direction, and further comprising deflectors located to convey the first and the second weft threads in the weft direction.

15. A loom, comprising a gripper head that is movable through an open shed in and counter to a weft direction, and the device according to claim 1 for feeding the first and the second weft thread in the weft direction to the gripper head.

16. A method for feeding a first and a second weft thread during production of woven fabric in a loom having a gripper head that draws the first and second weft threads through an open shed along a weft insertion line, the method comprising:

locating the first and second weft threads next to one another in a plane in a warp direction at an edge of the woven fabric;

moving the first and second weft threads in a first direction consisting of a linear axis path in the warp direction to position the first weft thread at the weft insertion line while deflecting the second weft thread clear of the weft insertion line;

feeding the first weft thread along the weft insertion line to the gripper head that draws the first weft thread through the open shed;

moving the first and second weft threads in a second opposite direction consisting of the linear axis path in the warp direction to position the second weft thread at the weft insertion line while deflecting the first weft thread clear of the weft insertion line; and feeding the second weft thread along the weft insertion line to the gripper head that draws the second weft thread through the open shed.

17. A device for feeding a first and a second weft thread in a weft direction to a gripper head of a loom, the device comprising:

a coupling unit configured to move back and forth in a warp direction when the device is installed laterally on the loom;

a first and a second feed unit adjacently arranged in the warp direction on the coupling unit, the first and the second feed units configured to feed the first and the second weft threads, respectively, to the gripper head;

a positioning unit configured to position the coupling unit in the warp direction in a first position of the coupling unit and counter to the warp direction in a second position of the coupling unit;

wherein the first feed unit feeds the first weft thread to the gripper head when the coupling unit is in the first position and the second feed unit feeds the second weft thread to the gripper head when the coupling unit is in the second position; and wherein each of the feed units comprises a strip-conveying unit having two revolving strip conveyors positionable in relation to each other, wherein the respective weft threads are conveyable in the weft direction between the strip conveyors.

18. A device for feeding a first and a second weft thread in a weft direction to a gripper head of a loom, the device comprising:

a coupling unit configured to move back and forth in a warp direction when the device is installed laterally on the loom;

a first and a second feed unit adjacently arranged in the warp direction on the coupling unit, the first and the second feed units configured to feed the first and the second weft threads, respectively, to the gripper head;

a positioning unit configured to position the coupling unit in the warp direction in a first position of the coupling unit and counter to the warp direction in a second position of the coupling unit;

wherein the first feed unit feeds the first weft thread to the gripper head when the coupling unit is in the first position and the second feed unit feeds the second weft thread to the gripper head when the coupling unit is in the second position;

wherein the coupling unit is configured on a fixed guide part having first guide structures, the coupling unit comprising guide elements that interact with the first guide structures to move the coupling unit in or counter to the warp direction; and wherein the first guide structures are configured to prevent one of the first or second feed units from moving in the weft direction as the coupling unit is positioned in and counter to the warp direction, and further comprising second guide structures on the guide part that enable the other of the second or first feed units to move in and counter to the weft direction.

* * * * *